US009259749B2

(12) United States Patent
Takebe et al.

(10) Patent No.: US 9,259,749 B2
(45) Date of Patent: Feb. 16, 2016

(54) ELECTROSTATIC PAINTING APPARATUS

(71) Applicant: HONDA MOTOR CO., LTD., Tokyo (JP)

(72) Inventors: Masashi Takebe, Tochigi (JP); Naoki Kishimoto, Tochigi (JP); Masaaki Shoji, Tochigi (JP); Toshiyuki Kokubo, Tochigi (JP); Takayuki Ueki, Tochigi (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 14/047,221

(22) Filed: Oct. 7, 2013

(65) Prior Publication Data

US 2014/0103149 A1 Apr. 17, 2014

(30) Foreign Application Priority Data

Oct. 12, 2012 (JP) ..... 2012-227137

(51) Int. Cl.

| | |
|---|---|
| ***B05B 5/00*** | (2006.01) |
| ***B05B 5/025*** | (2006.01) |
| ***B05B 5/16*** | (2006.01) |
| ***B05B 12/14*** | (2006.01) |

(52) U.S. Cl.

CPC ..... *B05B 5/025* (2013.01); *B05B 5/1625* (2013.01); *B05B 5/1675* (2013.01); *B05B 12/1409* (2013.01)

(58) Field of Classification Search

CPC ..... B05B 5/0255; B05B 5/00; B05B 5/084; B05B 15/00; B05B 15/10; B05B 9/01; B05B 13/0431; B05B 13/0452; B05B 15/061; B05B 9/047; B05B 15/0443; B05B 15/065; B05B 7/2408; B05B 9/03

USPC ..... 239/280, 690; 118/302

See application file for complete search history.

(56) References Cited

U.S. PATENT DOCUMENTS

| | | | | |
|---|---|---|---|---|
| 4,785,760 | A * | 11/1988 | Tholome | 118/323 |
| 6,458,424 | B1 * | 10/2002 | Yoshida et al. | 427/426 |
| 6,756,080 | B2 | 6/2004 | Ballu | |

(Continued)

FOREIGN PATENT DOCUMENTS

| | | |
|---|---|---|
| JP | 2005-521544 | 7/2005 |
| JP | 2009-508670 | 3/2009 |

(Continued)

OTHER PUBLICATIONS

Japanese Office Action and partial English translation dated May 13, 2014, 8 pages.

*Primary Examiner* — Len Tran
*Assistant Examiner* — Adam J Rogers
(74) *Attorney, Agent, or Firm* — Rankin, Hill & Clark LLP

(57) ABSTRACT

An electrostatic painting apparatus includes a painting gun having at one end thereof a paint spray section, and a connection section detachably connectable to an external paint supply section for receiving a supply of paint from the supply section and supplying the received paint to a paint storage section that stores and supplies the supplied paint to the painting gun. The connection section is surrounded and protected by a peripheral wall, so that paint can pass by the other end of the painting gun without reaching the connection section. Consequently, the connection section can be prevented from being undesirably smeared with the paint.

6 Claims, 12 Drawing Sheets

(56) References Cited

U.S. PATENT DOCUMENTS

| | | | | |
|---|---|---|---|---|
| 6,945,483 | B2 * | 9/2005 | Clifford et al. | 239/690.1 |
| 8,689,730 | B2 * | 4/2014 | Clifford | 118/629 |
| 2002/0158149 | A1 * | 10/2002 | Thome et al. | 239/305 |
| 2003/0157261 | A1 * | 8/2003 | Ballu | 427/421 |
| 2005/0023374 | A1 * | 2/2005 | Knobbe et al. | 239/280 |
| 2008/0230003 | A1 * | 9/2008 | Le Strat et al. | 118/313 |
| 2009/0211609 | A1 * | 8/2009 | Prauser et al. | 134/22.12 |
| 2009/0250003 | A1 * | 10/2009 | Umezawa et al. | 118/302 |
| 2010/0012743 | A1 * | 1/2010 | Nakazono et al. | 239/3 |
| 2013/0011567 | A1 * | 1/2013 | Takebe et al. | 427/401 |
| 2014/0144545 | A1 * | 5/2014 | Tarantini | 141/18 |

FOREIGN PATENT DOCUMENTS

| | | |
|---|---|---|
| WO | 2008/096452 | 8/2008 |
| WO | 2011/013680 | 2/2011 |

* cited by examiner

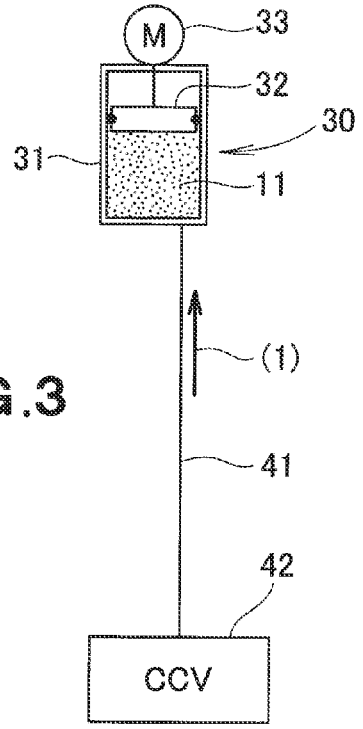
FIG.3
FIG.4
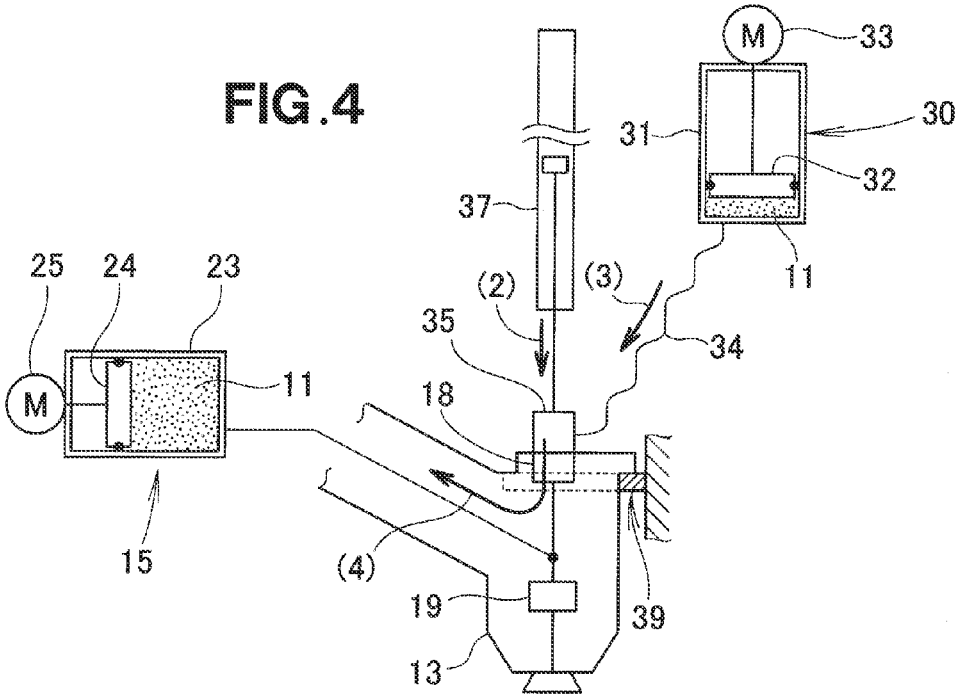

ELECTROSTATIC PAINTING APPARATUS

FIELD OF THE INVENTION

The present invention relates to an improvement of electrostatic painting apparatus.

BACKGROUND OF THE INVENTION

The electrostatic painting is a painting method which efficiently applies paint to a vehicle body with an electrostatic attractive force produced by setting the vehicle body at zero voltage and setting the paint at negative voltage. Also, it has been known to mount a painting gun on a robot (see, for example, FIGS. 1 and 2 of Japanese PCT-Based Patent Application Laid-Open Publication No. JP-A 2005-521544 (hereinafter referred to as "Patent Literature 1").

FIG. 13 is a diagram explanatory of a basic construction of an electrostatic paint apparatus disclosed in Patent Literature 1. A robot 103 is disposed laterally of a conveyor 102 conveying a vehicle body 101, and a painting gun 105 is mounted on an arm 104 of the robot 103. A paint supply section 107 is provided on a building 106 so that a predetermined amount of paint is supplied from the paint supply section 107 to the painting gun 105.

After the paint is supplied to the painting gun 105, the robot 103 turns the arm 104 and ejects or sprays the paint onto the vehicle body 101 by means of the painting gun 105, as shown in FIG. 14. Namely, predetermined electrostatic painting is performed on the vehicle body 101 with the painting gun 105 separated and electrically insulated from the paint supply section 107.

If painting of a multiplicity of different colors is to be performed by use of the single painting gun 105, so-called color change is executed. Cleaning liquid is supplied from the paint supply section 107 to the painting gun 105 to clean the painting gun 105. Next, paint of a desired new color is supplied from the paint supply section 107 to the painting gun 105. Because the paint supply section 107 and the painting gun 105 can be separated from each other, a cleaning range can be selectively limited to the painting gun 105, so that the cleaning liquid can be saved and the cleaning of the painting gun 105 can be done in a short time.

As paint is ejected or sprayed from the painting gun 105 in the illustrated example of FIG. 14, a portion of the sprayed paint may drift around the painting gun 105 as uncoated paint and undesirably adhere to a connection section 108 although most of the sprayed paint runs toward the vehicle body 101. If the sprayed paint adheres to the surface of the connection section 108, the connection section 108 cannot appropriately connect to the paint supply section 107. Thus, there arises a need to clean the connection section 108 at times, so efficiency of the painting operation would decrease because the painting operation is halted temporarily during the cleaning of the connection section 108.

Further, it is necessary to make it difficult for the connection section 108 to be soiled or smeared with the uncoated paint. If the connection section 108 can be made difficult to be smeared, frequency of the cleaning operation can be lowered, and thus, decrease in the efficiency of the painting operation can be minimized.

SUMMARY OF THE INVENTION

In view of the foregoing prior art problems, it is an object of the present invention to provide an improved electrostatic painting apparatus which can reliably eliminate a possibility of the connection section being smeared with the uncoated paint.

In order to accomplish the above-mentioned object, the present invention provides an improved electrostatic painting apparatus, which comprises: a painting gun having at one end thereof a paint spray section for spraying paint onto an object of painting; a gun movement means for moving the painting gun; a paint storage section provided on the gun movement means; a connection section provided on the gun movement means and detachably connectable to an external paint supply section for receiving a supply of paint from the external paint supply section and supplying the received paint to the paint storage section, the paint storage section storing therein a predetermined amount of the paint supplied from the connection section and supplying the stored paint to the painting gun; and a peripheral wall surrounding the connection section.

So-called "uncoated paint", which is a portion of the paint sprayed from the painting gun drifting around the painting gun without being appropriately painted onto an object of painting, such as a vehicle body, is blocked by the peripheral wall surrounding the connection section and thus does not reach the connection section (or is difficult to reach the connection section). As a result, according to the present invention, there can be provided an electrostatic painting apparatus where the connection section is difficult to be soiled or smeared with the uncoated paint. Because the connection section can be prevented from being easily smeared with the uncoated paint, the present invention can lower the frequency of the cleaning operation and thus minimize decrease in the efficiency of the painting operation.

Preferably, the connection section and the peripheral wall are provided at another end, remote from the one end, of the painting gun. Because the connection section is provided at the other end of the painting gun remote from the one end where the paint spray section is provided, the uncoated paint can be prevented from reaching the connection section with an increased reliability.

Preferably, the electrostatic painting apparatus of the present invention has a groove formed between the connection section and the peripheral wall. Thus, in case the paint leaks from between the connection section and the external paint supply section, the leaked paint is accumulated or retained in the groove. Thus, the present invention can eliminate a possibility of the leaked paint undesirably falling out onto the object of painting, such as a vehicle body.

Preferably, the external paint supply section has a fitting member provided thereon, and the connection section is connectable to the external paint supply section with the painting gun placed on the fitting member. Because the connection section can be connected to the external paint supply section with the painting gun placed on the fitting member, accurate positioning of the painting gun relative to the external paint supply section can be facilitated.

Preferably, the fitting member is a fork member of a generally U shape. In the case where the fitting member is constructed as such a fork member of a simple shape, it can be manufactured with ease at low cost.

Preferably, the fork member includes a bifurcated section formed in a generally semicircular arc shape, and the fork member is disposed in such a manner that the center of the semicircular arc of the fork member is aligned with the centerline of the external paint supply section. Further, the connection section is provided on the painting gun in such a manner that the center of the connection section can be aligned with the center of the generally semicircular arc of the bifurcated section of the fork member. Because the center of the generally semicircular arc is aligned with the centerline of the external paint supply section, a connector sleeve or mouthpiece of the external paint supply section can be positioned accurately relative to the connection section, and thus, the present invention can reliably prevent leakage of the paint from the connection section.

Preferably, the painting gun has a flange or a groove fittingly engageable with the fork member. By fittingly engaging the groove or flange of the painting gun with the fork member, the present invention can eliminate a need for enhancing accuracy of a stopped position of the gun movement means.

BRIEF DESCRIPTION OF THE DRAWINGS

Certain preferred embodiments of the present invention will hereinafter be described in detail, by way of example only, with reference to the accompanying drawings, in which:

FIG. 3 is a diagram explanatory of behavior of a color change valve in the embodiment of the electrostatic painting apparatus;

FIG. 4 is a diagram explanatory of behavior of an external paint supply section in the embodiment of the electrostatic painting apparatus;

DETAILED DESCRIPTION OF THE INVENTION

Figure 1:
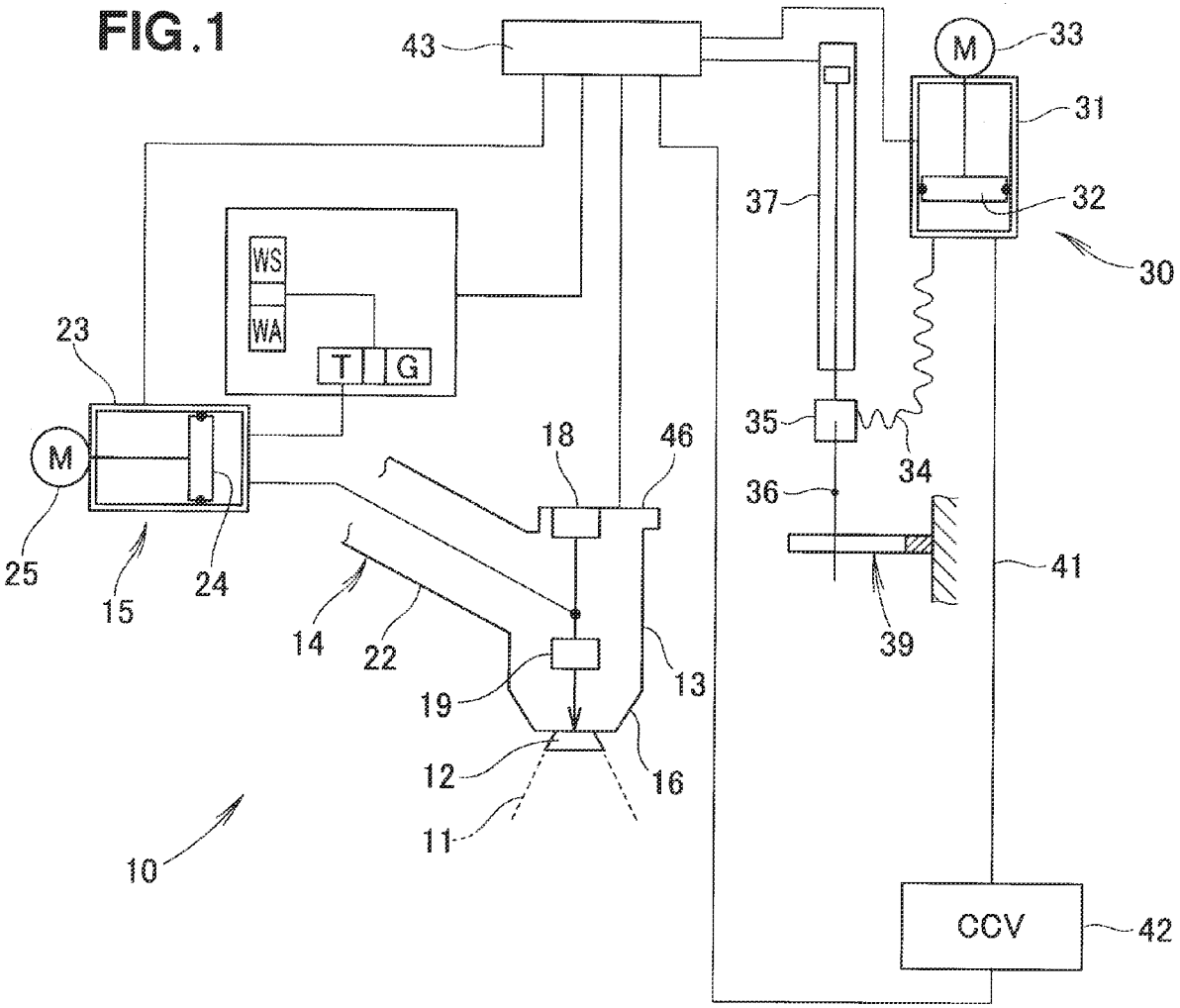
FIG. 1 is a schematic diagram showing a basic construction of an embodiment of an electrostatic painting apparatus of the present invention.

Reference is now made to FIG. 1, which is a schematic diagram showing a basic construction of an embodiment of an electrostatic painting apparatus 10 of the present invention. As shown in FIG. 1, the electrostatic painting apparatus 10 includes: a painting gun 13 having at its one end a paint spray section 12 for spraying a jet of paint 11; a gun movement section (means) 14 for moving the painting gun 13; a paint storage section 15 provided on the gun movement section 14 for storing a predetermined amount of paint and supplying the stored paint to the painting gun 13; an external paint supply section 30 provided on a separate position from the gun movement section 14 and painting gun 13 for supplying the paint 11; and a connection section 18 provided on the gun movement section 14 and detachably connectable to the external paint supply section 30 for receiving a supply of paint from the external paint supply section 30 and then supplying the received paint 11 to the paint storage section 15.

The paint spray section 12, which is also called "rotary atomizer head" or "bell cup", atomizes paint by centrifugal force and sprays the atomized paint onto an object to he painted (object of painting). The painting gun 13 is in the form of a cylinder having the paint spray section 12 at its one end and having an ON/OFF valve 19 incorporated therein.

The gun movement section 14 is preferably in the form of a robot (21 in FIG. 2), and the painting gun 13 may be mounted on an arm 22 if the gun movement section 14 is a robot.

The paint storage section 15 includes a first cylinder 23, a first piston 24 accommodated in the first cylinder 23, and a first actuator 25 for linearly moving the first piston 24 within the cylinder 23.

The external paint supply section 30 includes: a second cylinder 31 to which paint is supplied from a color change valve (CCV) section 42 via a paint path 41; a second piston 32 accommodated in the second cylinder 31; a second actuator 33 for linearly moving the second piston 32 within the cylinder 31; a hose 34 for directing paint pressed by the second piston 32 to the hose 32; a connector sleeve or mouthpiece 35 having the distal end of the hose 34 connected thereto; and a mouthpiece elevator section 37 for moving the mouthpiece 35 up and down along a vertical shaft 36.

The hose 34 may be a flexible hose, and the mouthpiece 35 is a block having a paint flow path therein.

The mouthpiece elevator section 37, which may be of any desired construction, is preferably a cylinder unit. In an alternatively the mouthpiece elevator section 37 may be in the form of a rack-and-pinion unit.

A fitting member 39 is disposed around a lower section of the vertical shaft 36. Although the fitting member 39 may be of any desired shape or form, it is preferably in the form of a fork member having a simple construction, and thus, the fitting member 39 will hereinafter be referred to as "fork member 39".

The CCV section 42, painting gun 13, first actuator 25, second actuator 33 and mouthpiece elevator section 37 are controlled by a control section 43.

Figure 2:
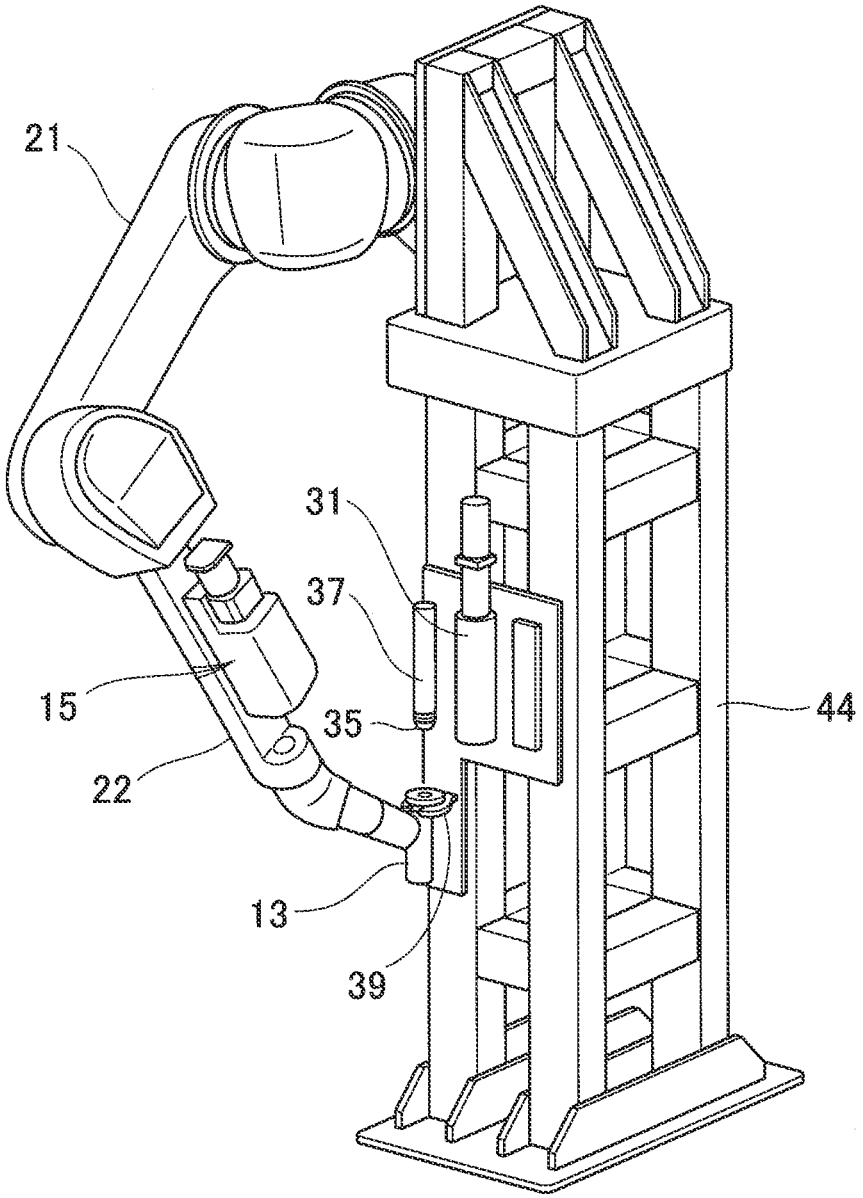
FIG. 2 is a perspective view showing principal sections of the embodiment of the electrostatic painting apparatus of the present invention.

Preferably, as shown in FIG. 2, the second cylinder 31 is provided on a columnar mount 44 supporting the robot 21, and the above-mentioned mouthpiece elevator section 37 is provided on the columnar mount 44 adjacent to one side of the second cylinder 31, and the fork member 39 is provided on the columnar mount 44 beneath the mouthpiece elevator section 37. Further, the painting gun 13 may be provided on the distal end of the arm 22 of the robot 21, and the paint storage section 15 may be provided on a halfway position of the arm 22.

Next, a description will be given about general behavior of the electrostatic painting apparatus 10.

As shown in FIG. 3, paint 11 of a desired color is supplied from the CCV section 42 and delivered to the second cylinder 31 via a route indicated by arrow (1), and then the paint 11 is stored into the second cylinder 31.

Then, as shown in FIG. 4, the painting gun 13 is inserted beneath the mouthpiece 35, and the mouthpiece 35 is connected to the connection section 18 of the painting gun 13 by being lowered as indicated by arrow (2). After that, the second piston 32 is lowered by the second actuator 33, so that the paint 11 is stored into the first cylinder 23 of the paint storage section 15 via routes indicated by arrows (3) and (4).

Figure 5:
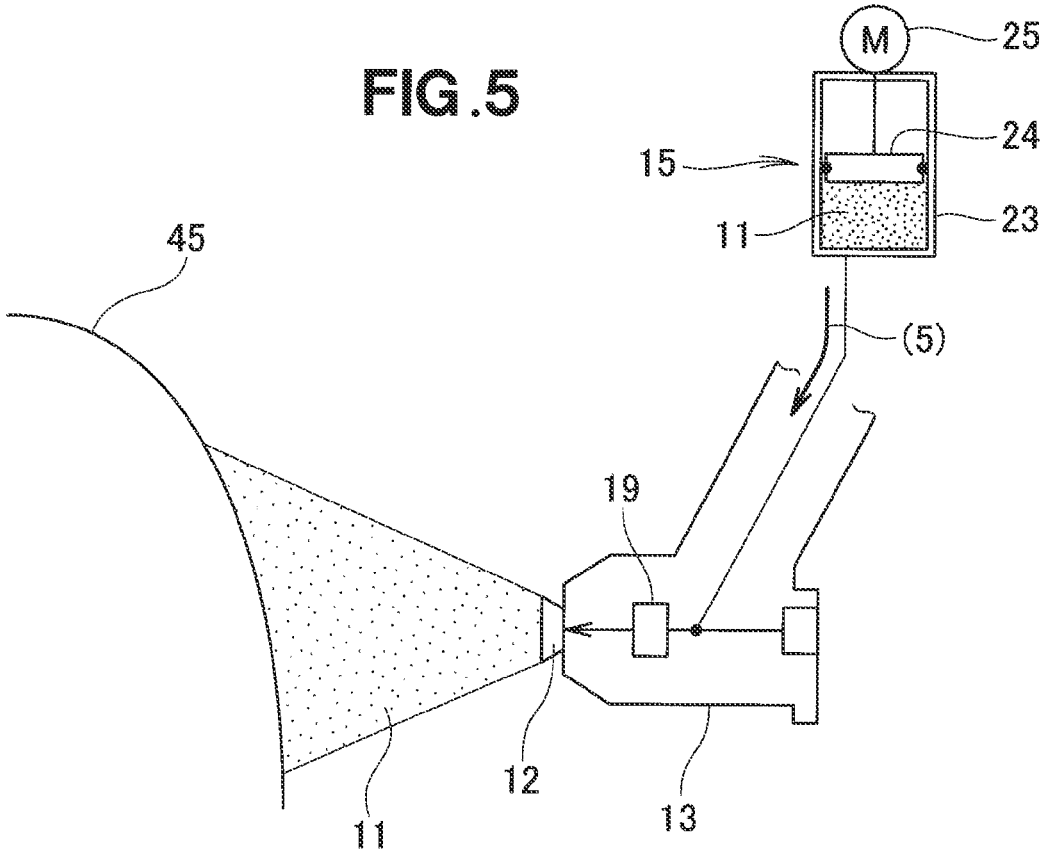
FIG. 5 is a diagram explanatory of behavior of a painting gun in the embodiment of the electrostatic painting apparatus.

Then, as shown in FIG. 5, the painting gun 13 is caused to face a vehicle body 45 as the object of painting, after which the ON/OFF valve 19 is opened so that the first pin 24 is moved forward by the first actuator 25. Thus, the paint 11 is sprayed onto the vehicle body 45 via a route indicated by arrow (5).

Figure 6:
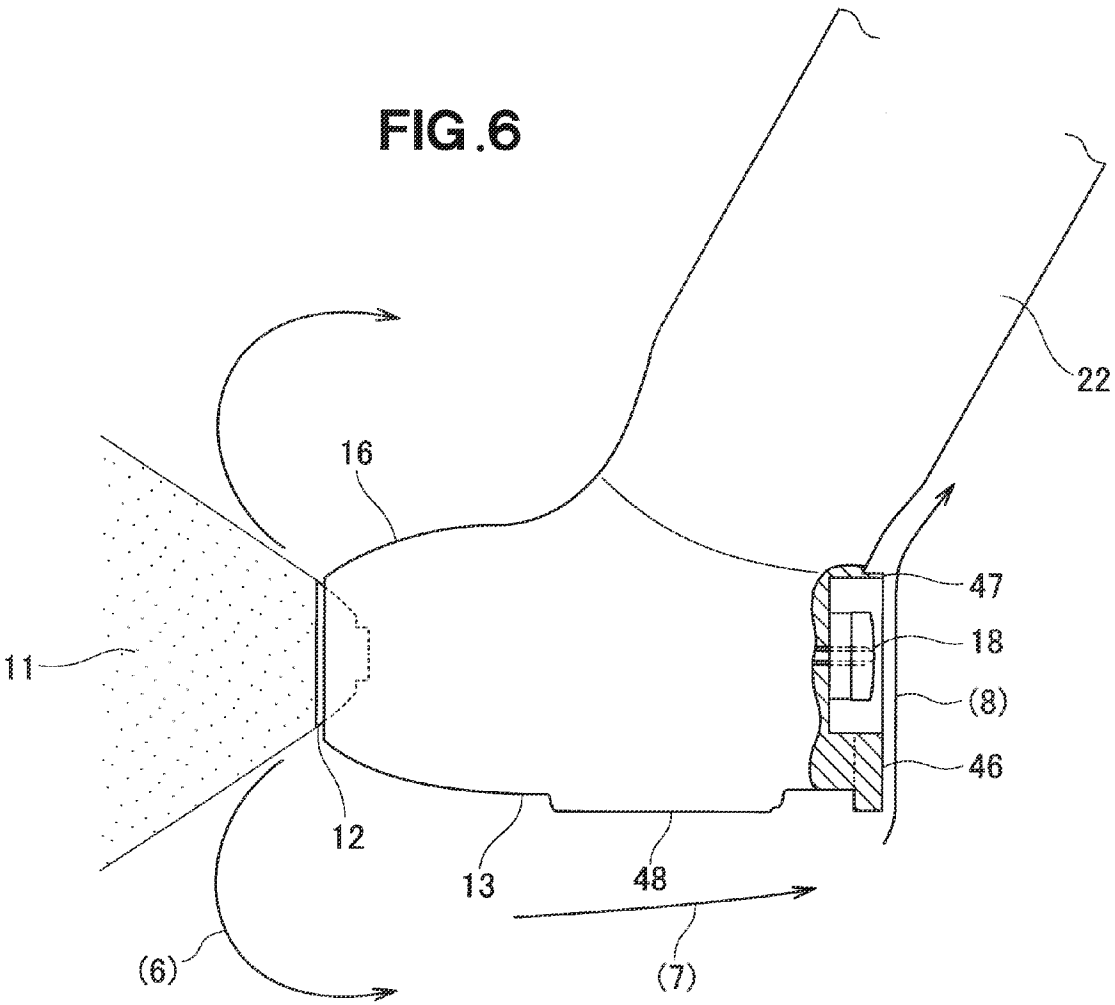
FIG. 6 is a diagram explanatory of behavior of a connection section in the embodiment of the electrostatic painting apparatus.

Further, as shown in FIG. 6, while the paint 11 is sprayed from the paint spray section 12 onto the vehicle body 45, a portion of the sprayed paint 11 travels around to sides of the painting gun 13 as indicated by arrows (6) and (7). Further, a portion of the sprayed paint 11 traveling around to sides of the painting gun 13 runs around to the other end 46 of the painting gun 13 as indicated by arrow (8).

Further, in the instant embodiment, the connection section 18 is surrounded by a peripheral wall 47. Because the connection section 18 is protected by the peripheral wall 47, the paint traveling as indicated by arrow (8) can pass by the other end 46 of the painting gun 13 without reaching the connection section 18. Consequently, the connection section 18 can be prevented from being undesirably coated or smeared with the paint 11. Even if a portion of the paint 11 adheres to the connection section 18, such a portion adhering to the connection section 18 is of a very small amount, and thus, the cleaning frequency of the connection section 18 can remain so low that it does not adversely influence the productivity of the painting operation.

In an alternative, the connection section 18 surrounded by the peripheral wall 47 may be provided on a side surface 48 of the painting gun 18, because the peripheral wall 47 functions as a guard for the connection section 18. Note, however, that the paint mist indicated by arrow (8) is smaller in amount than the paint mist indicated by arrow (7). Thus, in the case where the paint spray section 12 is provided at the one end of the painting gun 13, it is recommendable that the connection section 18 be disposed at the other end 46 remotest from the paint spray section 12.

Figure 7:
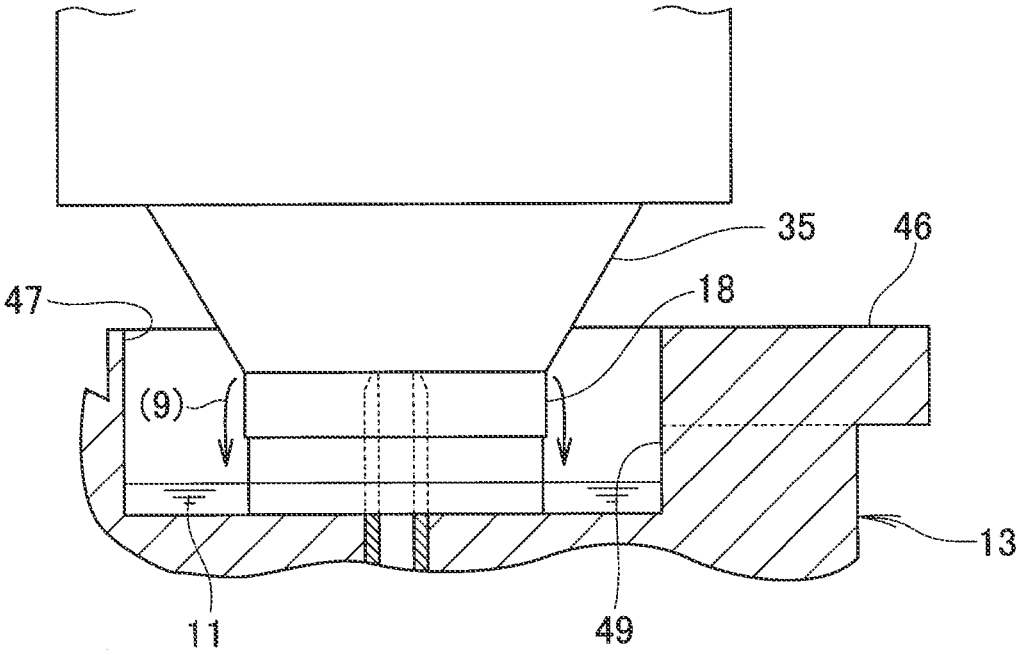
FIG. 7 is a diagram showing details of the connection section in the embodiment of the electrostatic painting apparatus.

The following describe in detail a more preferred embodiment of the connection section 18. According to the more preferred embodiment of the connection section 18, as shown in FIG. 7, a groove 49 of a relatively deep "moat" shape is formed between the connection section 18 and the peripheral wall 47. With the mouthpiece 35 fitted in the connection section 18, paint 11 is supplied to the painting gun 13. Although the paint 11 is not leaked in a normal state, it might be leaked for some reason. Even in case the paint 11 is leaked as indicated by arrow (9), the provision of the moat-shaped groove 49 allows the leaked paint 11 to be accumulated or retained in the groove 49.

If the paint 11 overflows from the peripheral wall 47, it might undesirably fall out onto the vehicle body. However, this preferred embodiment of the connection section 18 can avoid such an undesired possibility by virtue of the provision of the groove 49. Namely, in ease the paint mist adheres to and builds up or accumulates on the connection section 18, the preferred embodiment of the connection section 18 can prevent the accumulated paint from falling out onto the vehicle body by allowing the paint to fall into the moat-shaped groove 49. Note that, although the connection section 18 would change in posture depending on its usage, the paint (including the accumulated paint) can be prevented from readily jumping out of the groove 49 as long as it is accumulated in a bottom section of the groove 49, because the paint has a relatively high viscosity.

Figure 8:
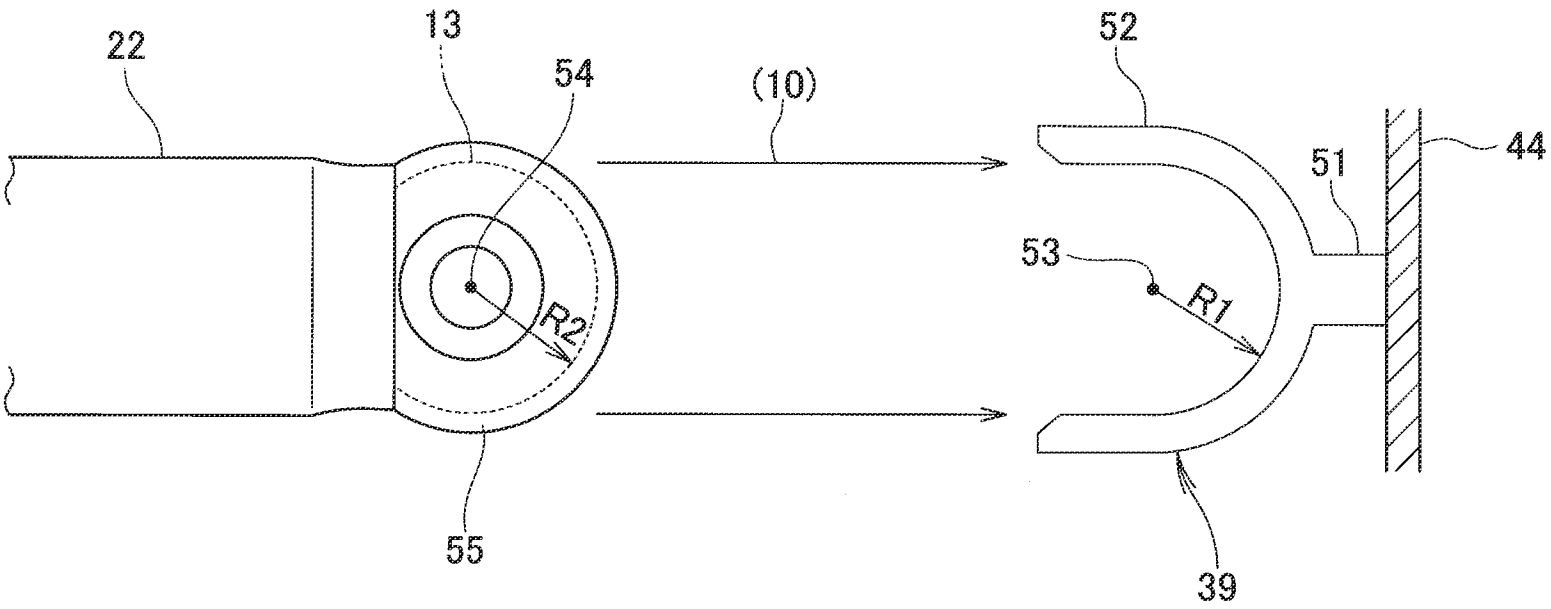
FIG. 8 is plan view of a fork member in the embodiment of the electrostatic painting apparatus.

The following describe in detail the fork member 39. As shown in FIG. 8, the fork member 39 includes a support section 51 fixed to the columnar mount 44, and a U-shaped bifurcated section 52 extending from the support section 51. Because the bifurcated section 52 is open on its distal end facing the painting gun 13, it can receive therein the painting gun 13 moving as indicated by arrow (10). More specifically, the bifurcated section 52 is formed in a generally semicircular arc shape with a radius R1 about a center 53. The painting gun 13 has an outer diameter R2, and the radius R1 of the bifurcated section 52 is set greater than the outer diameter R2 by several millimeters (R1=R2+several millimeters). In addition, the center 54 of the connection section. 18 is aligned with the center of the painting gun 13.

Figure 9:
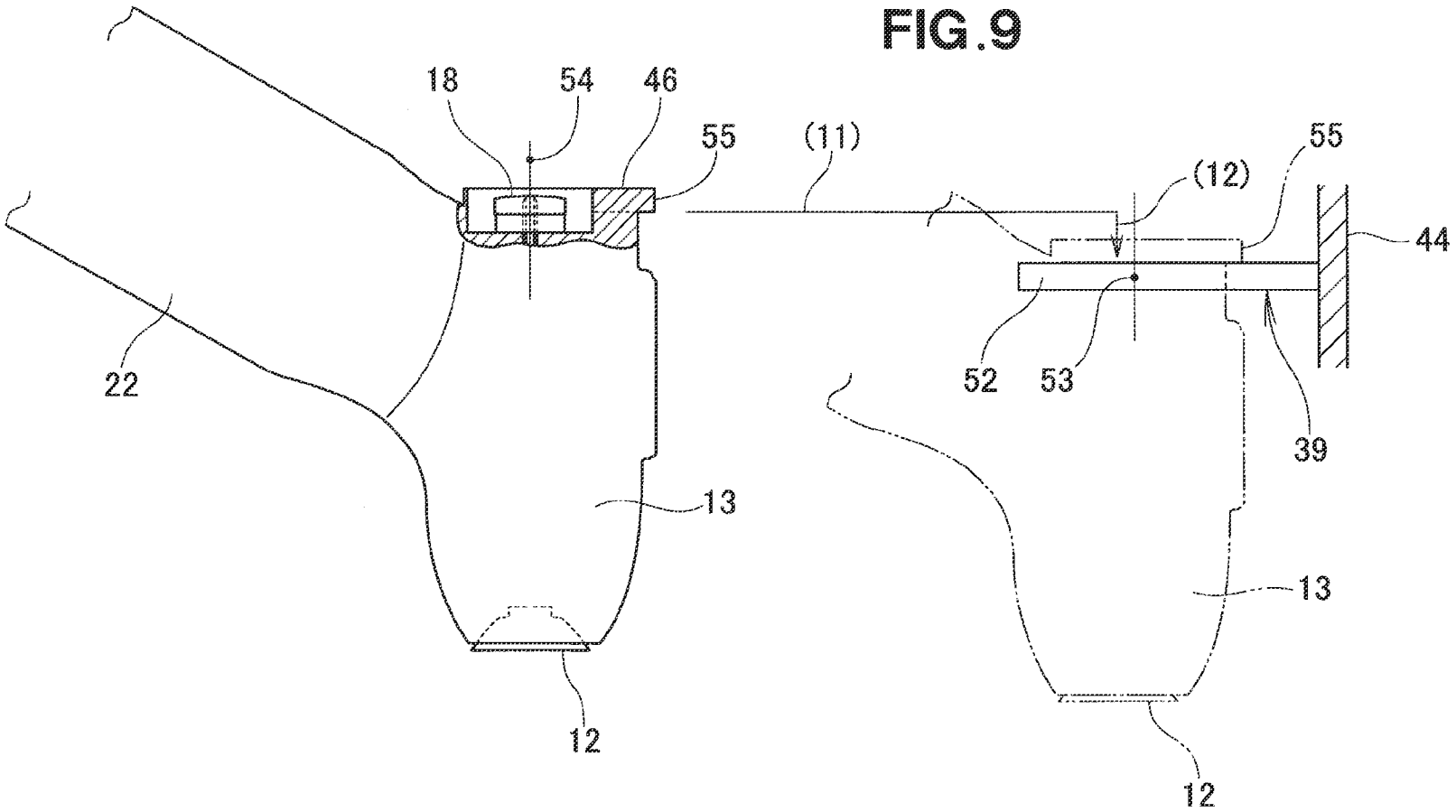
FIG. 9 is a side view of the fork member in the embodiment of the electrostatic painting apparatus.

Further, as shown in FIG. 9, the painting gun 13 has a flange 55 formed at the other end 46 and projecting radially outward. Then, the flange 55 of the painting gun 13 is positioned on the bifurcated section 52 in a manner as indicated by arrows (11) and (12). Thus, as shown in FIG. 8, the center of the painting gun 13 (and hence the center 54 of the connection section 18) can he aligned with the center 53 of the generally semicircular arc of the bifurcated section 52.

Positioning the center 54 of the connection section 18 in alignment with the mouthpiece 35 (FIG. 2) is very important to prevent leakage of the paint. If such positioning is left to the robot 21, teachings to the robot 21 would become complicated, which would adversely influence the productivity of the painting operation. However, the instant embodiment can significantly reduce the loads on the robot 21 by positioning the connection section 18 with the use of the bifurcated section 52 of the fork member 39 as noted above. Note that, although it is preferable that the bifurcated section 52 have a U shape, it may have a V or other channel shape.

Figure 10:
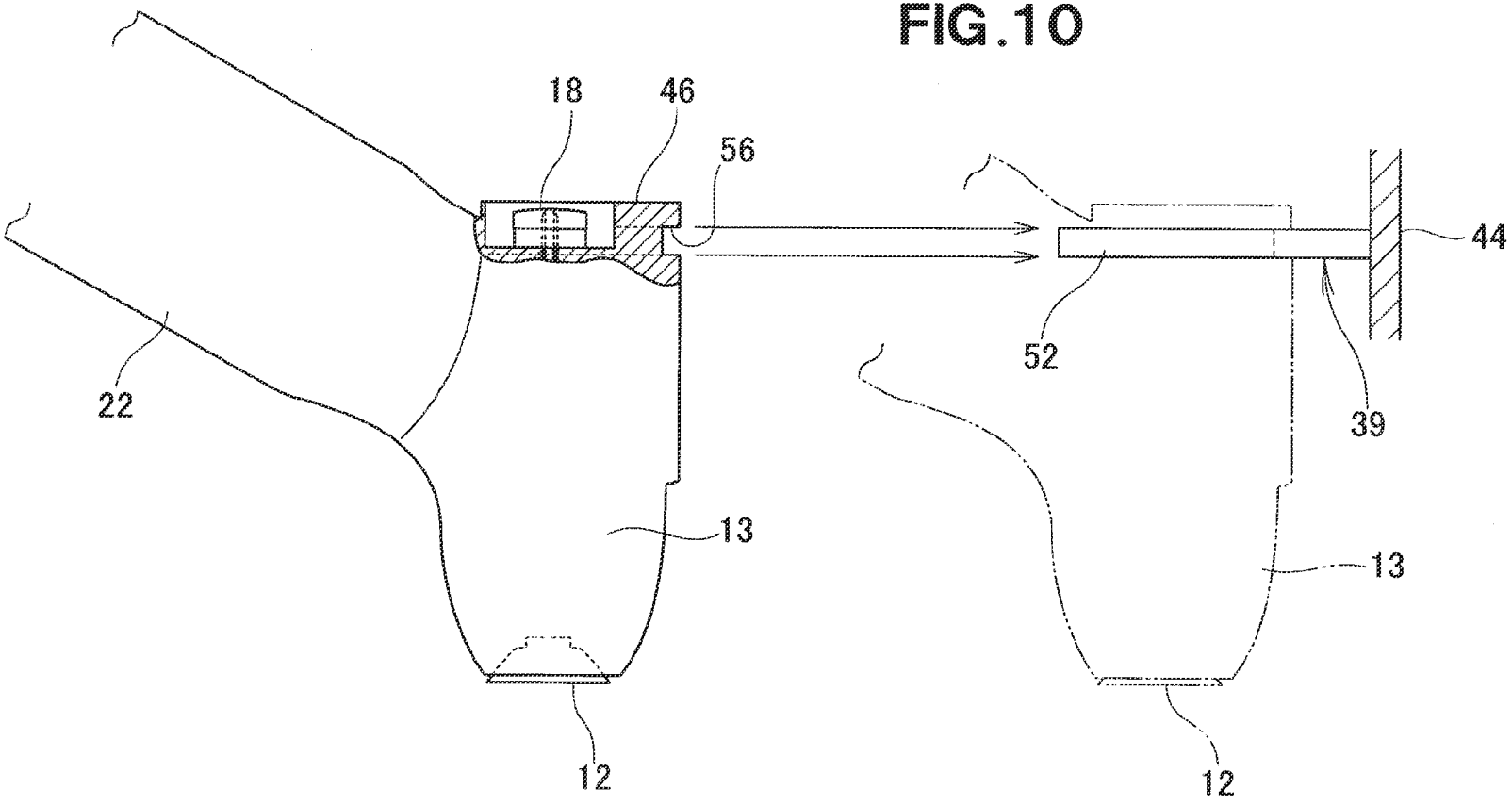
FIG. 10 is a diagram showing a modification of FIG. 9.

Further, as shown in FIG. 10, the painting gun 13 may have a groove 56 formed therein so that painting gun 13 can be accurately positioned by the groove 56 being fitted in the bifurcated section 52. Furthermore, the object of painting may be of any other desired types than vehicle bodies, such as electric appliances, general industrial goods, etc.

Figure 11:
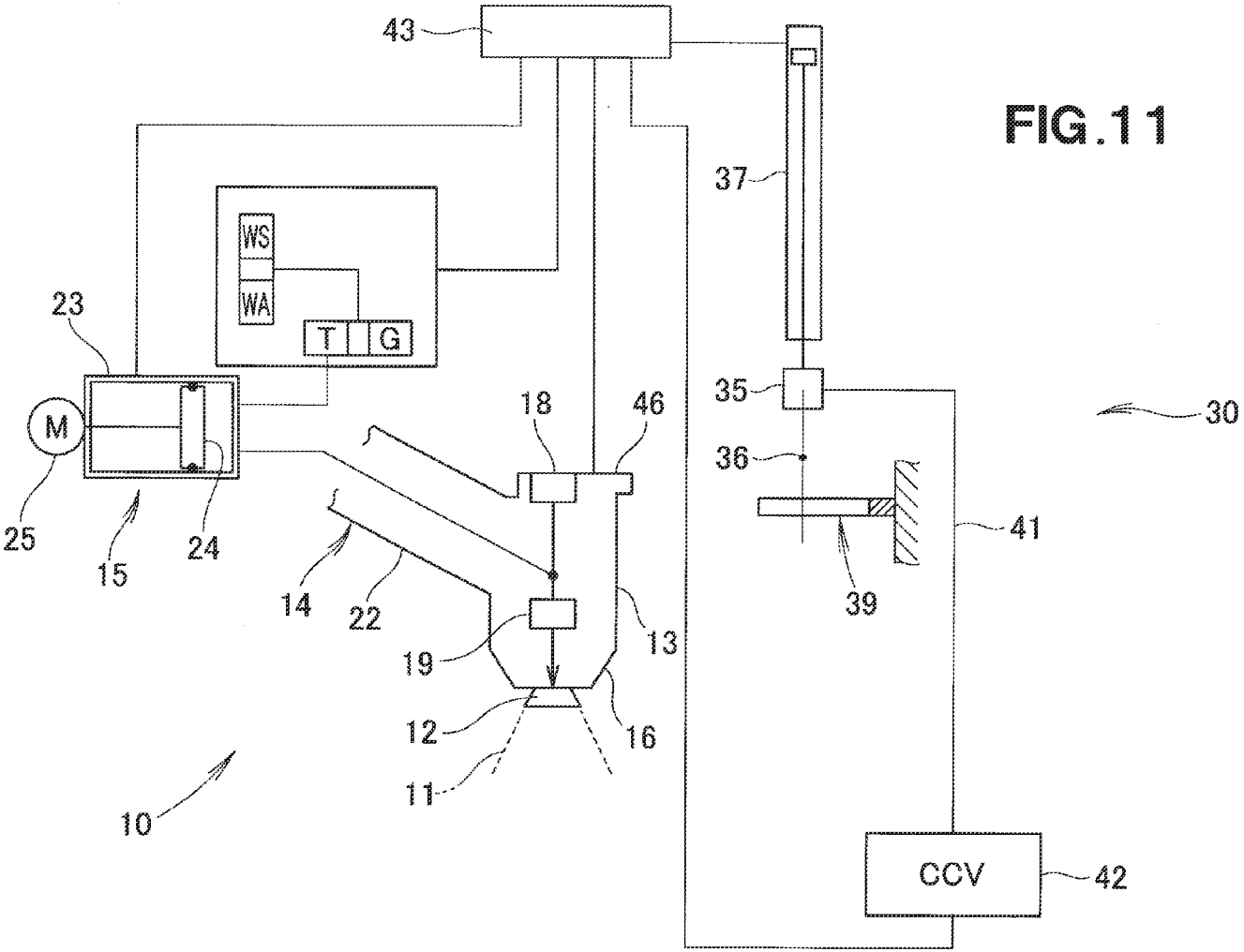
FIG. 11 is a diagram showing a modification of FIG. 1.

Next, a description will be given about modifications of the present invention. As shown in FIG. 11, the paint path 41 extending from the CCV section 42 may be connected to the mouthpiece 35. Consequently, in the modification shown in FIG. 11, the second cylinder 31, the second piston 32, the second actuator 33 and the hose 34 can be omitted or dispensed with. Namely, in the modification shown in FIG. 11, the external paint supply section 30 only includes the CCV section 42, the paint path 41, the mouthpiece 35 and the mouthpiece elevator section 37.

Figure 12:
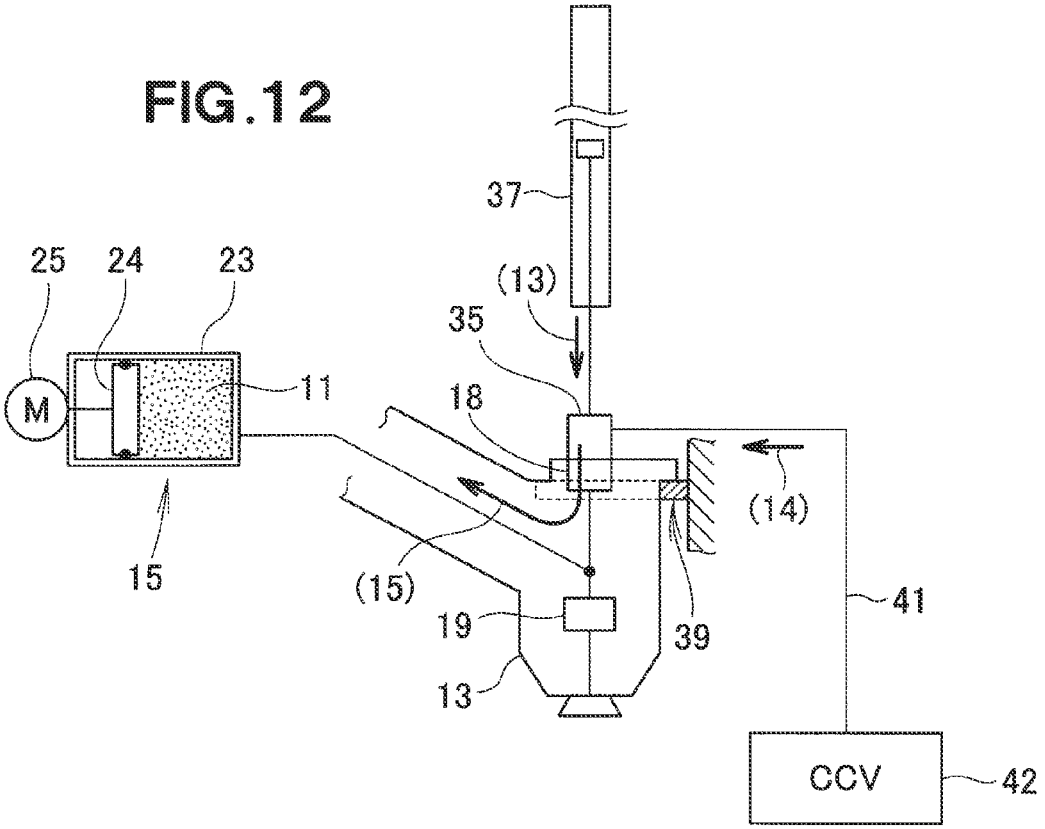
FIG. 12 is a diagram showing a modification of FIG. 4.
Figure 13:
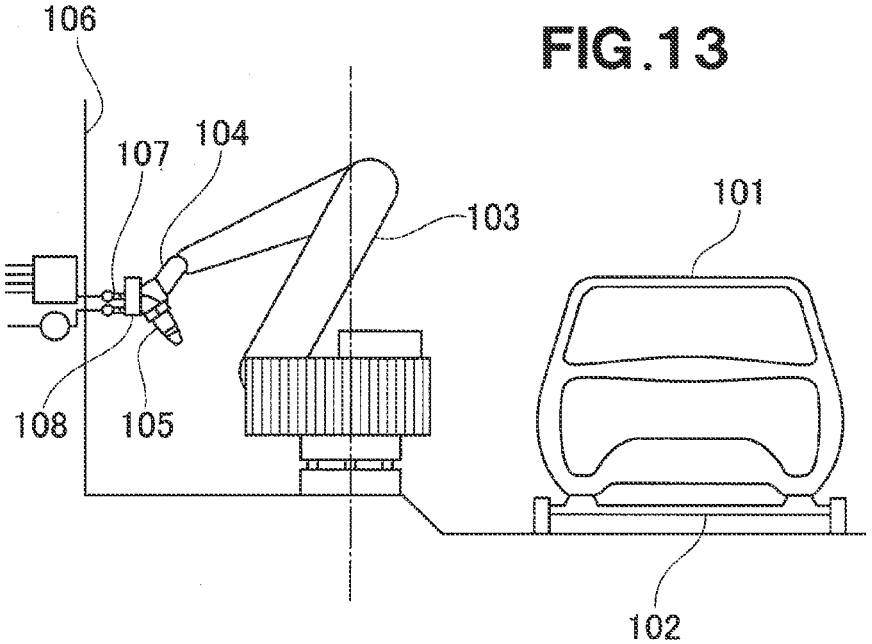
FIG. 13 is a diagrammatic illustration of a basic construction of a conventionally-known electrostatic painting apparatus.
Figure 14:
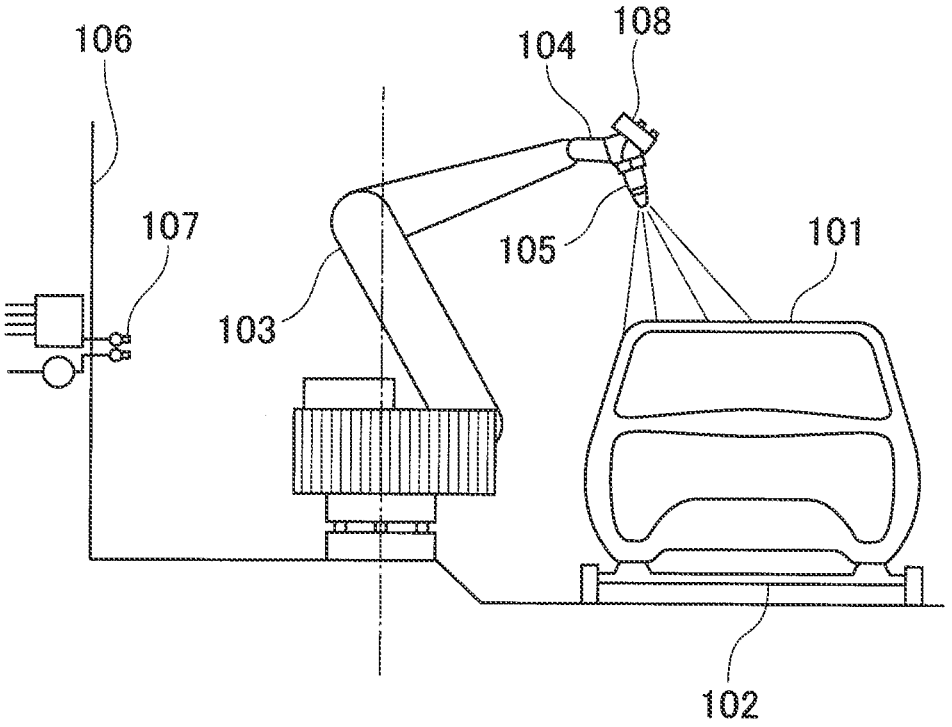
FIG. 14 is a diagrammatic illustration of behavior of the conventionally-known electrostatic painting apparatus.

Further, as shown in FIG. 12, the painting gun 13 is inserted beneath the mouthpiece 35, and the mouthpiece 35 is connected to the connection section 18 of the painting gun 13 by being lowered as indicated by arrow (13). After that, a not-shown valve in the CCV 42 is opened. Then, the paint 11 is stored into the first cylinder 31 via routes indicated by arrows (14) and (15). Subsequent operations are similar to those described above in relation to FIG. 5 and thus will not be described here to avoid unnecessary duplication.

The above-described basic principles of the present invention are well suited for application to electrostatic painting apparatus in which a painting gun has a connection section and in which the connection section is connected to an external paint supply section to receive a supply of paint from the external paint supply section.

What is claimed is:

1. An electrostatic painting apparatus comprising:

a painting gun having a first end and a second end opposite to the first end, the painting gun further having a paint spray section provided at the first end thereof for spraying paint onto an object of painting;

a gun movement means for moving the painting gun, the gun movement means comprising a robot having an arm, the painting gun being mounted on the arm of the robot;

a paint storage section provided on the gun movement means;

a connection section provided on the painting gun and detachably connectable to an external paint supply section for receiving a supply of paint from the external paint supply section and supplying the received paint to the paint storage section, the paint storage section storing therein a predetermined amount of the paint supplied from the connection section and supplying the stored paint to the painting gun; and a peripheral wall surrounding the connection section, wherein the connection section and the peripheral wall are provided at the second end of the painting gun, wherein the connection section is exposed while the paint spray section sprays the paint onto the object of painting with the painting gun mounted on the arm of the robot, wherein the paint spraying section provided at the first end of the painting gun and the connection section provided at the second end of the painting gun are aligned with each other, and wherein the peripheral wall has a height larger than a height of the connection section, the peripheral wall conceals the connection section from view when the painting gun is viewed in a direction perpendicular to a common axis of the paint spray section and the connection section, and when the painting gun is spraying the paint onto the object of painting with the connection section disconnected from the external paint supply section, the peripheral wall guides a portion of the sprayed paint to pass by the second end of the painting gun without reaching the connection section.

2. The electrostatic painting apparatus according to claim 1, wherein the connection section and the peripheral wall define an annular groove therebetween, for retaining leaked paint therein, the leaked paint is paint that leaks out while the connection section receives the supply of paint from the external paint supply section.

3. The electrostatic painting apparatus according to claim 1, wherein the external paint supply section has a fitting member provided thereon, and the connection section is connectable to the external paint supply section with the painting gun placed on the fitting member.

4. The electrostatic painting apparatus according to claim 3, wherein the fitting member is a fork member of a generally U shape.

5. The electrostatic painting apparatus according to claim 4, wherein the fork member includes a bifurcated section formed in a generally semicircular arc shape, and the fork member is disposed in such a manner that center of the generally semicircular arc of the fork member is aligned with a centerline of the external paint supply section, and wherein the connection section is provided on the painting gun in such a manner that a center of the connection section can be aligned with the center of the generally semicircular arc of the bifurcated section of the fork member.

6. The electrostatic painting apparatus according to claim 4, wherein the painting gun has a flange or a groove fittingly engageable with the fork member.

* * * * *